US009105975B2

(12) United States Patent
Satou et al.

(10) Patent No.: US 9,105,975 B2
(45) Date of Patent: Aug. 11, 2015

(54) ANTENNA DEVICE AND PORTABLE WIRELESS TERMINAL EQUIPPED WITH THE SAME

(75) Inventors: Hiroshi Satou, Kanagawa (JP); Takanori Hirobe, Ishikawa (JP); Yoshio Koyanagi, Kanagawa (JP); Tomoaki Nishikido, Ishikawa (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 324 days.

(21) Appl. No.: 13/698,181

(22) PCT Filed: May 16, 2011

(86) PCT No.: PCT/JP2011/002714
§ 371 (c)(1),
(2), (4) Date: Nov. 15, 2012

(87) PCT Pub. No.: WO2011/145323
PCT Pub. Date: Nov. 24, 2011

(65) Prior Publication Data

US 2013/0057448 A1 Mar. 7, 2013

(30) Foreign Application Priority Data

May 17, 2010 (JP) ..... 2010-112852

(51) Int. Cl.
*H01Q 21/00* (2006.01)
*H01Q 1/52* (2006.01)
(Continued)

(52) U.S. Cl.
CPC ..... *H01Q 1/52* (2013.01); *H01Q 1/243* (2013.01); *H01Q 1/36* (2013.01); *H01Q 9/42* (2013.01); *H01Q 21/28* (2013.01)

(58) Field of Classification Search
CPC ..... H01Q 3/26; H01Q 21/08; H01Q 1/246
USPC ..... 343/853, 893, 702
See application file for complete search history.

(56) References Cited

U.S. PATENT DOCUMENTS 5,526,003 A 6/1996 Ogawa et al.
2008/0258991 A1 10/2008 Montgomery et al.
(Continued)

FOREIGN PATENT DOCUMENTS

JP 7-288423 A 10/1995
JP 08-084013 A 3/1996
(Continued)

OTHER PUBLICATIONS

Andersen et al., "Decoupling and Descattering Networks for Antennas," IEEE Transactions on Antennas and Propagation, Nov. 1976, pp. 841-846.
(Continued)

*Primary Examiner* — Dameon E Levi
*Assistant Examiner* — Collin Dawkins
(74) *Attorney, Agent, or Firm* — Seed IP Law Group PLLC

(57) ABSTRACT

A second slit 117 and a fourth slit 119 provided in a first antenna element 150 and a first slit 116 and a third slit 118 provided in a second antenna element 151 are adjusted such that the mutual coupling between the first antenna element 150 and the second antenna element 151 in the desired frequency band is canceled, and reduces degradation in coupling between antenna elements without connecting the antenna elements through components and the like. With such a configuration, it is possible to achieve high-efficiency loosely coupled MIMO array antennas operating in the same frequency band in a portable wireless terminal.

5 Claims, 6 Drawing Sheets

(51) Int. Cl.

| | |
|---|---|
| ***H01Q 1/36*** | (2006.01) |
| ***H01Q 9/42*** | (2006.01) |
| ***H01Q 21/28*** | (2006.01) |
| ***H01Q 1/24*** | (2006.01) |

(56) References Cited

U.S. PATENT DOCUMENTS

| | | | | |
|---|---|---|---|---|
| 2009/0189824 | A1* | 7/2009 | Nishikido et al. | 343/826 |
| 2009/0273523 | A1* | 11/2009 | Sakuma | 343/700 MS |
| 2010/0013720 | A1 | 1/2010 | Sakata et al. | |
| 2010/0097285 | A1* | 4/2010 | Hayashi et al. | 343/803 |
| 2011/0012797 | A1 | 1/2011 | Tani et al. | |

FOREIGN PATENT DOCUMENTS

| | | | |
|---|---|---|---|
| JP | 3855893 | B2 | 12/2006 |
| JP | 2007-282124 | A | 10/2007 |
| JP | 2008-125036 | A | 5/2008 |
| JP | 2009-206847 | A | 9/2009 |
| JP | 2009-272685 | A | 11/2009 |
| JP | 2010-28413 | A | 2/2010 |
| WO | 2009-113142 | A1 | 9/2009 |

OTHER PUBLICATIONS

International Search Report, mailed Aug. 16, 2011, for PCT/JP2011/002714, 4 pages.

* cited by examiner 4.0nH
0.6pF
(a)
S11
S12
S11, S12 [dB]
0
-5
-10
-15
-20
-25
-30
2
2.5
3
3.5
4
4.5
5
FREQUENCY [GHz]
(b)
ANTENNA EFFICIENCY [dB]
0
-2
-4
-6
-8
-10
FREQUENCY [GHz]
(c)
CORRELATION
1
0.8
0.6
0.4
0.2
0
FREQUENCY [MHz]
(d)

ANTENNA DEVICE AND PORTABLE WIRELESS TERMINAL EQUIPPED WITH THE SAME

TECHNICAL FIELD

The present invention relates to an antenna device and a portable wireless terminal equipped with the same. In particular, the present invention relates to an array antenna for a portable terminal, and which achieves high antenna efficiency as a result of loose coupling between two adjacent elements.

BACKGROUND ART

Portable wireless terminals such as mobile phones have been developed to have more and more functions, for example not only the telephone function, the electronic mail function, and the function of access to the Internet, but also the near-field wireless communication function, the wireless LAN function, the GPS function, the TV-viewing function, the IC card transaction function, and the like. In addition, in cellular communication, as a technique for achieving a high-speed and high-capacity wireless communication system, it can be expected to provide spatial multiplexing transfer (MIMO: Multi-Input Multi-Output) for performing communication by using a plurality of antennas on the transmission side and the reception side. In this technique, the spatial multiplexing is performed by transmitting the same signals which are space-time coded from a plurality of transmission antennas in the same band, and information is extracted by receiving and separating the signals through a plurality of reception antennas. Thereby, the transfer speed is improved, and thus it becomes possible to perform high-capacity communication. As the number of functions thereof increases, the number of antennas mounted in the portable wireless terminal tends to increase. Thus, there is a serious problem in that degradation in the antenna performance is caused by coupling between the plurality of antenna elements.

On the other hand, from the viewpoint of design and mobility, it is desired that the portable wireless terminal has a further small size and is highly integrated. In order to maintain favorable antenna characteristics while achieving reduction in size of the device, it is necessary to study arrangement of the antenna elements and coupling between the antenna elements in various ways. Further, a high-performance antenna system, which is subject to the coupling degradation countermeasures by reducing the number of power supply paths and the number of antenna elements as much as possible, is required.

As the existing portable wireless device coping with the problem of the coupling between the antenna elements, for example, as disclosed in PTL 1 and NPL 1, there is a known configuration in which low correlation between antennas is achieved by connecting the power supply sections of the array antenna elements through a connection circuit inserted therebetween so as to cancel the mutual coupling impedance between antennas.

CITATION LIST

Patent Literatures

[PTL 1] US2008-A-0258991

[PTL 2] Pamphlet of International Publication WO 09/113142

[PTL 3] JP-A-7-288423

Non Patent Literatures

[NPL 1] "Decoupling and descattering networks for antennas", IEEE Transactions on Antennas and Propagation, vol. 24 Issue 6, November 1976

SUMMARY OF INVENTION

Technical Problem

However, in the existing configuration disclosed in PTL 1 and NPL 1, the connection element 606 is operated to form current distribution in which the phase of the coupling between elements is inverse. Thus, capacitors, inductors, other transmission lines, combinations thereof, and the like are connected between elements or feeding points, thereby obtaining a loosely coupled array antenna. Hence, components have to be disposed to connect the antennas, and thus there is a problem of structural limitations and an increase in cost.

Further, in the existing configuration disclosed in PTL 2, by adopting a box structure in a similar manner as the antenna element 5, broadband characteristics are achieved. However, there is no description about the loose coupling technique which is necessary to achieve MIMO.

Further, in the existing configuration disclosed in PTL 3, by adjusting the length of the slit, the self-resonant frequency of the antenna element is adjusted. However, there is no description about means for adjusting the loose coupling frequency when two antennas are set to be close to each other.

In the present invention, in the portable wireless terminal on which two or more antenna elements for MIMO and the like are mounted in an array, in order to solve the above-mentioned problem, it is desired to provide an array antenna device, which is capable of achieving high antenna efficiency and a low coefficient of correlation between antennas by achieving loose coupling without connecting antennas through components and the like with a configuration in which a plurality of rectangular parallelepiped antenna elements formed by folding flat plates are disposed substantially in parallel to be close to each other and slits are provided on the respective rectangular parallelepiped antenna elements, and it is also desired to provide a portable wireless terminal equipped with the array antenna device.

Solution to Problem

An antenna device of the present invention includes: a casing; a circuit board that is provided in the casing and has a ground pattern; a first antenna element that includes a first conductor plate which is disposed in and near the casing and is conductive and substantially rectangular, a second conductor plate which shares one side of the first conductor plate in a widthwise direction thereof, is disposed on the first conductor plate at approximately 90 degrees, and is substantially rectangular, and a third conductor plate which shares the other side in the widthwise direction opposed to the one side of the second conductor plate shared with the first conductor plate, is disposed at approximately 90 degrees so as to be opposed to the first conductor plate, and is substantially rectangular; and a second antenna element that includes a fourth conductor plate which is disposed in and near the casing and is conductive and substantially rectangular, a fifth conductor plate which shares one side of the fourth conductor plate in a widthwise direction thereof, is disposed on the fourth conductor plate at approximately 90 degrees, and is substantially rectangular, and a sixth conductor plate which shares the other side in the widthwise direction opposed to the one side of the fifth conductor plate shared with the fourth conductor plate, is disposed at approximately 90 degrees so as to be opposed to the fourth conductor plate, and is substantially rectangular. At least one slit with a predetermined length is provided in at least one of the first conductor plate, the second conductor plate, or the third conductor plate of the first antenna element. At least one slit with a predetermined length is provided in at least one of the fourth conductor plate, the fifth conductor plate, or the sixth conductor plate of the second antenna element. The first antenna element and the second antenna element are disposed to be close to each other substantially in parallel with each other at a predetermined distance away from the ground pattern on the circuit board, and are electrically connected to a first power supply section and a second power supply section, which are disposed on the circuit board, at both ends of one side of the circuit board. A position and a length of the slit are adjusted such that mutual coupling between the first antenna element and the second antenna element in a first frequency band is canceled.

With such a configuration, even when the antenna elements are not connected through components and the like, it is possible to achieve a loosely coupled array antenna with the first frequency band. In addition, it is possible to achieve a low coefficient of correlation between antennas, and it is possible to elongate the path of the current flowing in the antennas. As a result, compared with antennas with an equivalent antenna volume, it is possible to achieve high antenna efficiency.

Further, in the antenna device of the present invention, the first antenna element is electrically connected to the first power supply section through a first impedance matching circuit, and the second antenna element is electrically connected to the second power supply section through a second impedance matching circuit.

With such a configuration, in the desired frequency band, it is possible to achieve antenna characteristics capable of obtaining further loose coupling, matching, a low coefficient of correlation between antennas, and high antenna efficiency.

Further, the antenna device of the present invention is a MIMO antenna device.

Further, the antenna device of the present invention is mounted in a portable wireless terminal.

With such a configuration, it is possible to improve the antenna characteristics of the portable wireless terminal, and thus it is possible to reduce the size of the portable wireless terminal.

Advantageous Effects of Invention

According to the antenna device of the present invention and portable wireless terminal equipped with the same, in a case where the antenna elements are disposed to be close, it is possible to achieve a loosely coupled array antenna device and a portable wireless terminal equipped with the same without connecting the antenna elements through components and the like.

DESCRIPTION OF EMBODIMENTS

Hereinafter, embodiments of the present invention will be described with reference to drawings.

Embodiment 1

Figure 1:
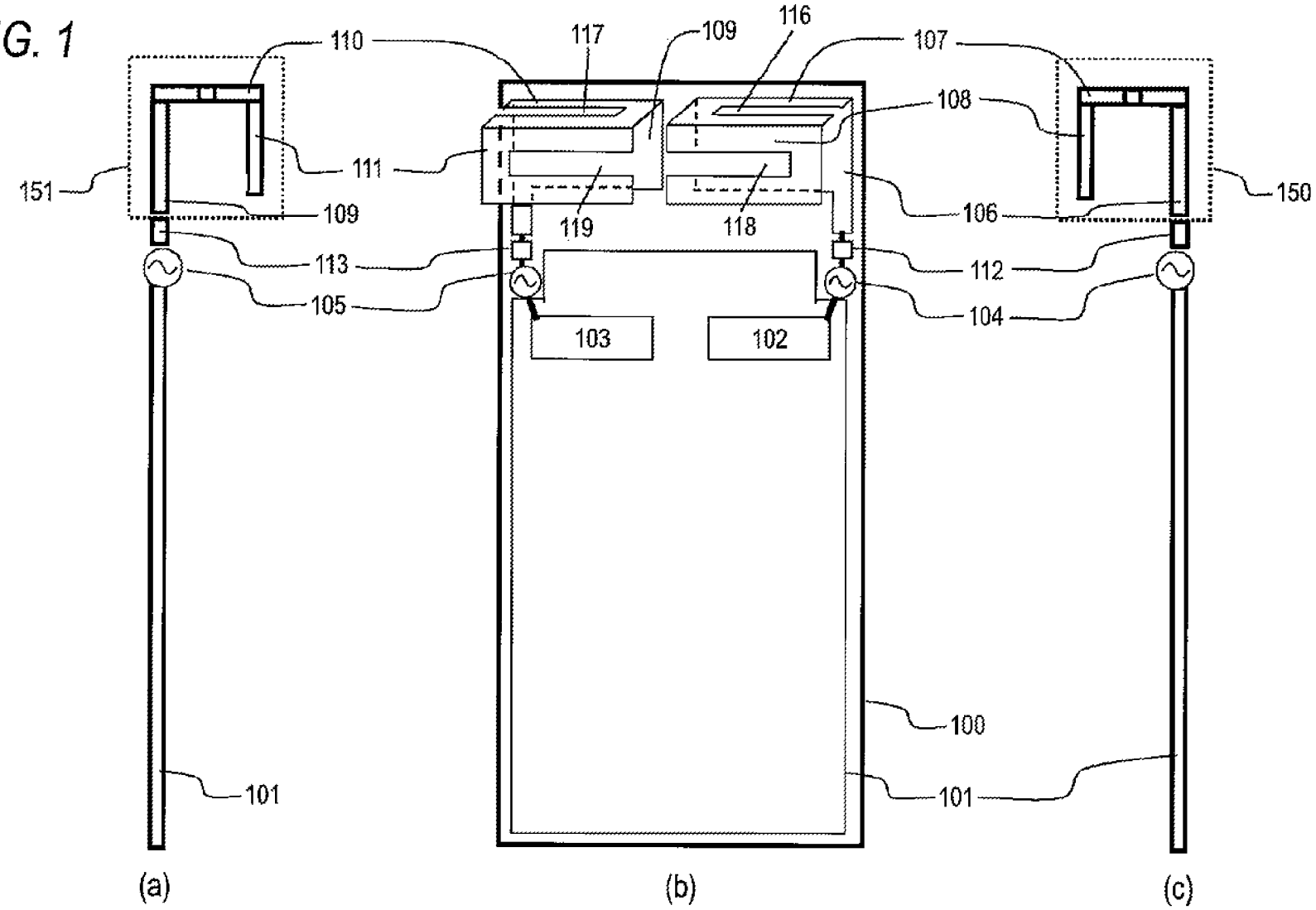
FIGS. 1(*a*) to 1(*c*) are configuration diagrams of a portable wireless terminal according to Embodiment 1 of the present invention.

FIGS. 1(*a*) to 1(*c*) are configuration diagrams of a portable wireless terminal according to Embodiment 1 of the present invention. FIG. 1(*a*) is a configuration diagram of the portable terminal viewed from the left side, and FIG. 1(*b*) is a diagram showing a view from the front. Further, FIG. 1(*c*) is a configuration diagram showing a view from the right side.

As shown in FIGS. 1(*a*) to 1(*c*), a circuit board 101 disposed in the portable wireless terminal 100 includes a first wireless circuit section 102. Thus, a first antenna element 150 made of a conductive metal is supplied with a high-frequency signal through a first power supply section 104.

Here, the first antenna element 150 includes: a first conductor plate 106 which is conductive and substantially rectangular; a second conductor plate 107 which shares one side of the first conductor plate 106 in a widthwise direction thereof, is disposed thereon at approximately 90 degrees, and is substantially rectangular; and a third conductor plate 108 which shares the other side in the widthwise direction opposed to the one side of the second conductor plate 107 shared with the first conductor plate 106, is disposed at approximately 90 degrees so as to be opposed to the first conductor plate 106, and is substantially rectangular.

Furthermore, the circuit board 101 includes a second wireless circuit section 103. Thus, a second antenna element 151 made of a conductive metal is supplied with a high-frequency signal through a second power supply section 105.

Here, the second antenna element 151 includes: a fourth conductor plate 109 which is conductive and substantially rectangular; a fifth conductor plate 110 which shares one side of the fourth conductor plate 109 in a widthwise direction thereof, is disposed thereon at approximately 90 degrees, and is substantially rectangular; and a sixth conductor plate 111 which shares the other side in the widthwise direction opposed to the one side of the fifth conductor plate 110 shared with the fourth conductor plate 109, is disposed at approximately 90 degrees so as to be opposed to the first conductor plate 106, and is substantially rectangular.

With such a configuration, each of the first antenna element 150 and the second antenna element 151 is able to obtain broadband frequency characteristics. However, in the first antenna element 150 and the second antenna element 151, the leading end portions of the elements are disposed substantially in parallel at a distance of 0.02 wavelength or less with respect to the desired center frequency of 3.5 GHz from the center portion of the portable wireless terminal 100 in the widthwise direction. Hence, the high-frequency current, which flows in one antenna element due to the mutual coupling between the antenna elements, flows as induced current in the other antenna element. As a result, the radiation performance of the antenna deteriorates.

Therefore, a first slit 116 and a second slit 117 are provided on the second conductor plate 107 and the fifth conductor plate 110, and a third slit 118 and a fourth slit 119 are provided on the third conductor plate 108 and sixth conductor plate 111, thereby using means for canceling the mutual coupling between the antennas in the desired frequency band. The first slit 116 and the second slit 117 are slits of which the sides opposed to the sides close to the first antenna element 150 and the second antenna element 151 are formed as openings, and the third slit 118 and the fourth slit 119 are slits of which the sides close to the first antenna element 150 and the second antenna element 151 are formed as openings. By providing the slits, it is possible to form a capacity between elements at arbitrary places on adjacent portions between the first antenna element 150 and the second antenna element 151. Thus, by canceling the mutual coupling in the predetermined frequency band, it is possible to improve degradation in the coupling between the antenna elements.

Furthermore, the first antenna element 150 is connected to the first power supply section 104 through a first impedance matching circuit 112, and the second antenna element 151 is connected to the second power supply section 105 through a second impedance matching circuit 113. By arranging the first impedance matching circuit 112 and the second impedance matching circuit 113, it is possible to further minutely adjust the impedance matching of the first antenna element 150, the impedance matching of the second antenna element 151, and the mutual coupling between the antenna elements. Thus, the effect that reduces coupling degradation further increases.

It should be noted that, in the configuration of FIGS. 1(*a*) to 1(*c*), although the first antenna element 150 and the second antenna element 151 are described as conductive metal components, a part or all of the elements may be formed as copper foil patterns formed on the printed-circuit board. Even in this case, it is possible to obtain the same effect.

With the above-mentioned configuration, in the desired frequency band. S parameters S12 and S21, which are pass characteristics between the first power supply section 104 and the second power supply section 105, can be suppressed to remain low. Thus, it is possible to improve the coupling degradation.

Subsequently, a description will be given of an example in which the performance of the specific configuration of FIGS. 1(*a*) to 1(*c*) is analyzed.

Figure 2:
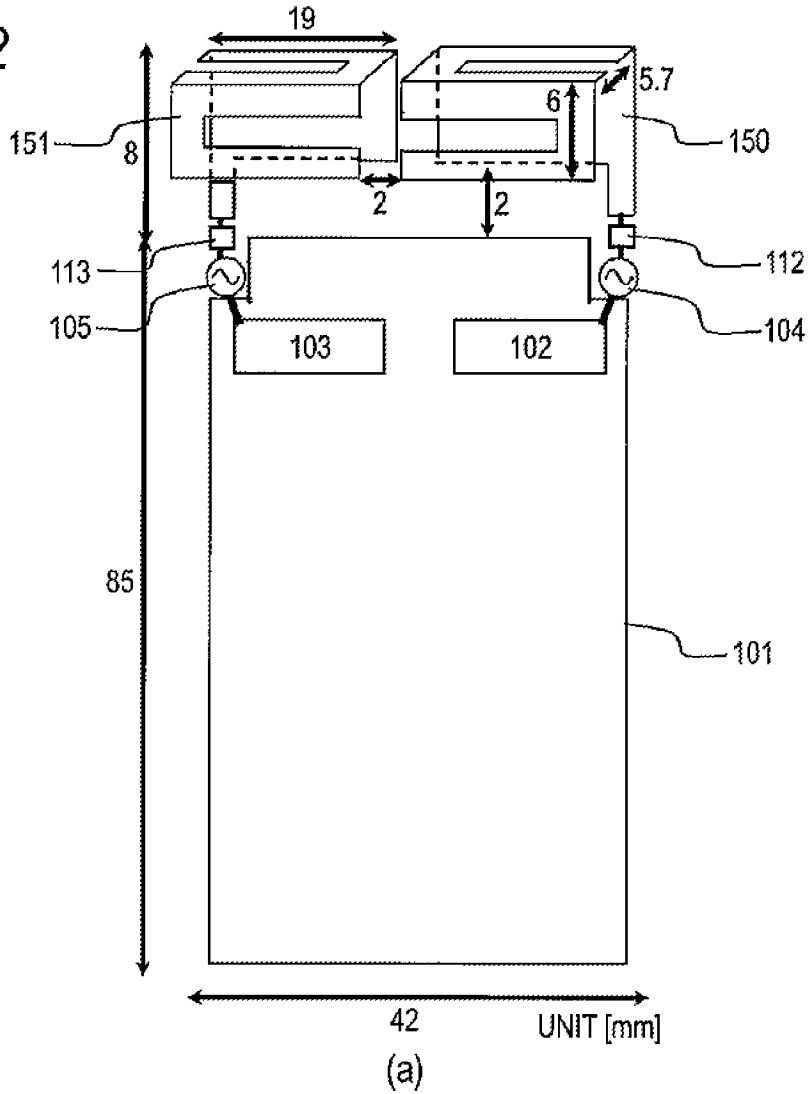
FIGS. 2(*a*) and 2(*b*) are diagrams illustrating a characteristic analysis model of the portable wireless terminal according to Embodiment 1 of the present invention.
Figure 2:
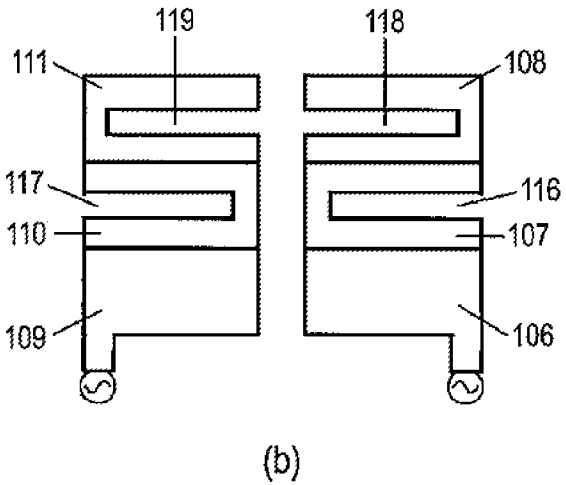

FIGS. 2(*a*) and 2(*b*) are diagrams illustrating a characteristic analysis model of the portable wireless terminal according to Embodiment 1 of the present invention. FIG. 2(*a*) is a diagram showing a view from the front. Further, FIG. 2(*b*) is a development view of the first antenna element 150 and the second antenna element 151.

As shown in FIG. 2(*a*), the circuit board 101 is formed as a printed-circuit board made of glass epoxy. However, the circuit board is modeled to be formed of a copper foil with a length of 85 mm and a width of 42 mm, and is analyzed. In the circuit board 101, the first antenna element 150 and the second antenna element 151 formed of conductive copper plates are supplied with the high-frequency signal through the first power supply section 104 and the second power supply section 105.

The high-frequency signals having the first frequency band of 2.0 GHz and the second frequency band of 5.0 GHz were supplied from the first power supply section 104 and the second power supply section 105, and analysis was performed on the coefficient of correlation between the antenna elements, radiation efficiency, and the pass characteristic 821 and the reflection characteristic S11 which are the S parameters.

The first antenna element 150 includes: the first conductor plate 106 with a length of 6 mm and a width of 19 mm; the second conductor plate 107 with a length of 5.7 mm and a width of 19 mm; and the third conductor plate 108 with a length of 6 mm and a width of 19 mm. The second conductor plate 107 is disposed on the first conductor plate 106 at 90 degrees, and one side of the second conductor plate 107 in the widthwise direction is in common with one side of the first conductor plate 106 in the widthwise direction. The third conductor plate 108 is disposed to be opposed to the first conductor plate 106, and one side of the third conductor plate 108 in the widthwise direction is in common with the other side in the widthwise direction opposed to the side of the second conductor plate 107 shared with the first conductor plate 106.

On the other hand, the second antenna element 151 includes: the fourth conductor plate 109 with a length of 6 mm and a width of 19 mm; the fifth conductor plate 110 with a length of 5.7 mm and a width of 19 mm; and the sixth conductor plate 111 with a length of 6 mm and a width of 19 mm. The fifth conductor plate 110 is disposed on the fourth conductor plate 109 at 90 degrees, and one side of the fifth conductor plate 110 in the widthwise direction is in common with one side of the fourth conductor plate 109 in the widthwise direction. The sixth conductor plate 111 is disposed to be opposed to the fourth conductor plate 109, and one side of the sixth conductor plate 111 in the widthwise direction is in common with the other side in the widthwise direction opposed to the side of the fifth conductor plate 110 shared with the fourth conductor plate 109.

The first antenna element 150 and the second antenna element 151 are disposed at the end portions of the circuit board 101, and the first conductor plate 106 and the fourth conductor plate 109 are formed to be coplanar with the circuit board 101. The space of the parallel portion, which is closest to the first antenna element 150 and the second antenna element 151, between the elements is 2 mm, and is disposed to be a space extremely approximate to 0.02 wavelength at the center frequency of 3.5 GHz between the first frequency band of 2.0 GHz and the second frequency band of 5.0 GHz.

As shown in FIG. 2(*b*), slits are disposed on the first antenna element 150 and the second antenna element 151.

The first slit 116 is disposed on the second conductor plate 107, and the second slit 117 is disposed on the fifth conductor plate 110. Thus, the first slit 116 and the second slit 117 are slits of which the sides opposed to the sides close to the first antenna element 150 and the second antenna element 151 are formed as openings. Further, the third slit 118 is disposed on the third conductor plate 108, and the fourth slit 119 is disposed on the sixth conductor plate 111. Thus, the third slit 118 and the fourth slit 119 are slits of which the sides close to the first antenna element 150 and the second antenna element 151 are formed as openings.

Each slit is disposed at the center of each short side of the second conductor plate 107, the fifth conductor plate 110, the third conductor plate 108, and the sixth conductor plate 111, and each size thereof is 1 mm×18 mm. The first antenna element 150 and the second antenna element 151 have a symmetric structure, and regarding the slit shape and the insertion position, the first slit 116 and the second slit 117 are formed in target shapes, and the third slit 118 and the fourth slit 119 are formed in target shapes.

By providing the slits on the conductor plate, the first antenna element 150 and the second antenna element 151 are formed in meander shapes. Thus, since the entire length of the antenna element increases, there is an effect that lowers the resonance frequency.

Further, by providing the slits, the positions of the adjacent portions between the first antenna element 150 and the second antenna element 151 are changed as viewed from the power supply sections. Thereby, it is possible to form a capacity between elements at arbitrary places on the adjacent portions between elements. Hence, by adjusting the capacity between the elements so as to cancel the mutual coupling in the predetermined frequency band, it is possible to improve degradation in the coupling between the antenna elements.

Furthermore, by disposing the first impedance matching circuit 112 and the second impedance matching circuit 113 at the origins of the respective antenna elements, it is possible to further minutely adjust the impedance matching of the first antenna element 150, the impedance matching of the second antenna element 151, and the mutual coupling between the antenna elements. Thus, the effect that reduces coupling degradation further increases.

Figure 3:
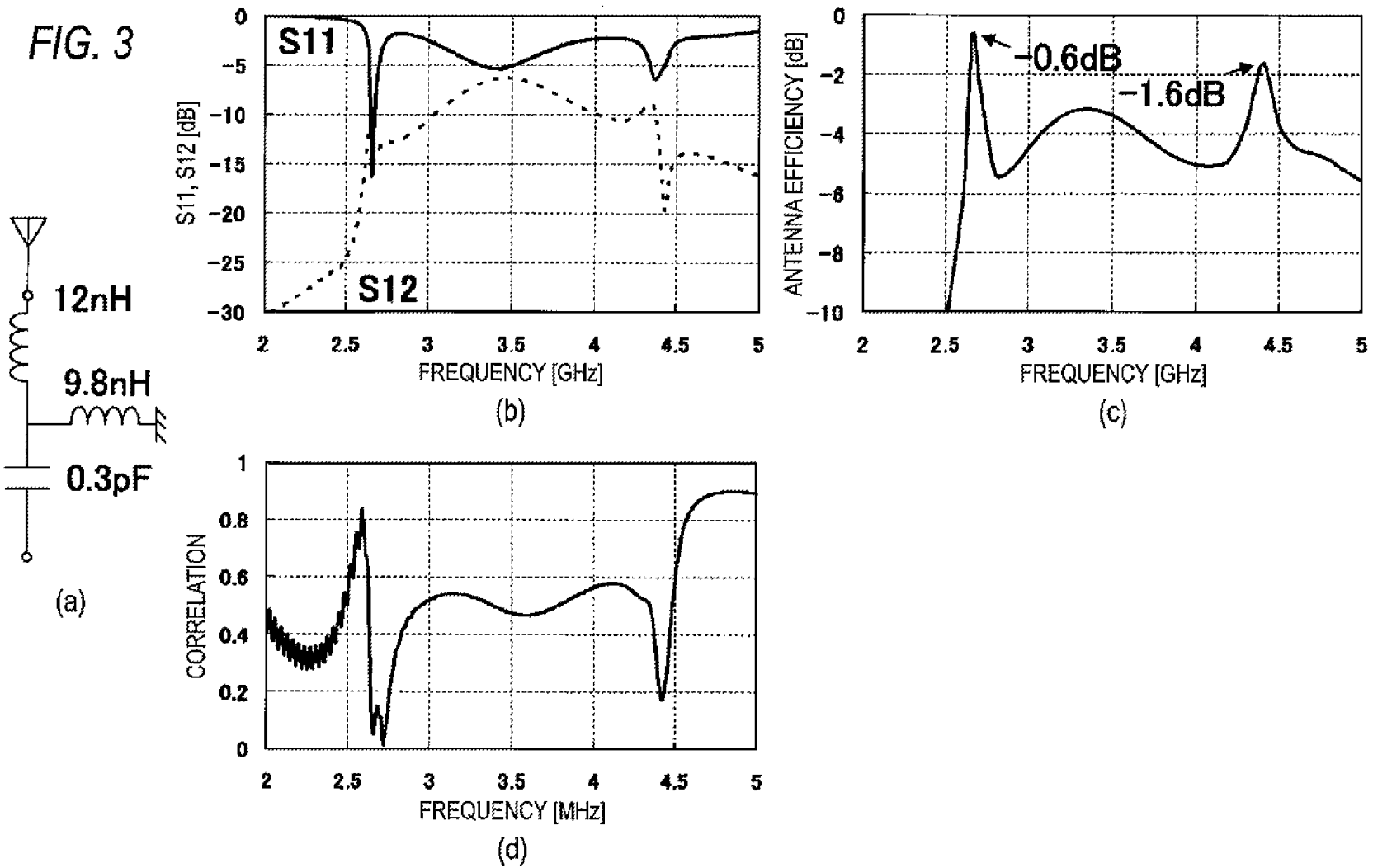
FIGS. 3(*a*) to 3(*d*) are first characteristic diagrams of the portable wireless terminal according to Embodiment 1 of the present invention.
Figure 4:
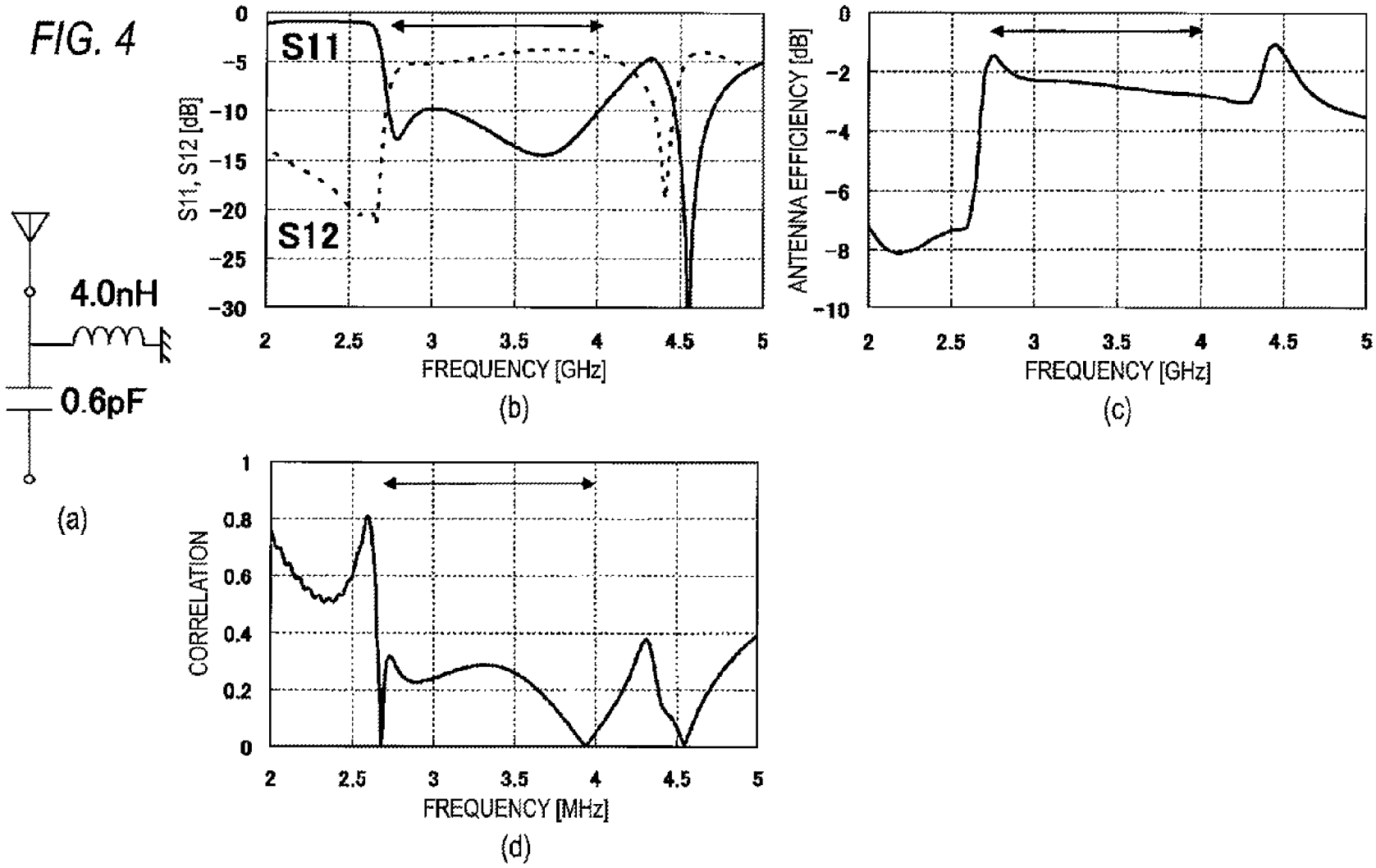
FIGS. 4(*a*) to 4(*d*) are second characteristic diagrams of the portable wireless terminal according to Embodiment 1 of the present invention.

FIGS. 3(*a*) to 3(*d*) are first characteristic diagrams of the portable wireless terminal according to Embodiment 1 of the present invention. FIGS. 4(*a*) to 4(*d*) are second characteristic diagrams of the portable wireless terminal according to Embodiment 1 of the present invention.

FIG. 3(*a*) shows the first impedance matching circuit 112 and the second impedance matching circuit 113. The first impedance matching circuit 112 and the second impedance matching circuit 113 have the same configuration. FIG. 3(*b*) shows the S11 waveform viewed from the first power supply section 104, and the S12 waveform which is pass characteristics from the first power supply section 104 to the second power supply section 105. FIG. 3(*c*) shows the antenna efficiency of the first antenna element 150. FIG. 3(*d*) shows the coefficient of correlation between the first antenna element 150 and the second antenna element 151. In each diagram, the horizontal axis indicates the characteristics of the frequency range from 2 GHz to 5 GHz.

As shown in FIG. 3(*a*), in the first impedance matching circuit 112 and the second impedance matching circuit 113, in order from the antenna element to the power supply section, 12 nH is set for the serial connection, 9.8 nH is set for the ground pattern of the circuit board, and 0.3 pF is set for the serial connection. The first antenna element 150 and the second antenna element 151 have a symmetric structure. Further, the first antenna element 150 and the second antenna element 151 have a circuit configuration, in which the first impedance matching circuit 112 and the second impedance matching circuit 113 are symmetric, in order to obtain the same impedance characteristics. Thereby, the impedances of the antennas are matched in the first frequency band of 2.66 GHz and the second frequency band of 4.4 GHz.

FIG. 3(*b*) shows the reflection characteristic S11 and the pass characteristic S21 as the S parameters. In the first frequency band of 2.66 GHz and the second frequency band of 4.4 GHz, S11 is less than or equal to −5 dB, and thus it can be observed that it is possible to obtain matching. Since the analysis models of FIGS. 2(*a*) and 2(*b*) are bilaterally symmetric, S22 is also a low value less than or equal to −5 dB, but the graph thereof is omitted herein.

Furthermore, in the first frequency band of 2.66 GHz and the second frequency band of 4.4 GHz, S21 as the pass characteristic is a low value less than or equal to −5 dB. Since the analysis models of FIGS. 2(*a*) and 2(*b*) are bilaterally symmetric, S12 is also a low value less than or equal to −5 dB, but the graph thereof is omitted herein.

As described above, in the first frequency band of 2.66 GHz and the second frequency band of 4.4 GHz, it is possible to ensure the impedance matching and isolation. As a result, it can be observed that the coupling degradation is reduced.

FIG. 3(*c*) shows the antenna efficiency of the first antenna element 150. The antenna efficiency of −0.6 dB is obtained in the first frequency band of 2.66 GHz, and the antenna efficiency of −1.6 dB is obtained in the second frequency band of 4.4 GHz. In the first frequency band of 2.66 GHz and the second frequency band of 4.4 GHz, the impedance matching and isolation is ensured, and thus it can be observed that it is possible to obtain high antenna efficiency greater than or equal to −3 dB.

Since the analysis models of FIGS. 2(*a*) and 2(*b*) are bilaterally symmetric, the second antenna element 151 also has equivalent antenna efficiency, but the graph thereof is omitted herein.

FIG. 3(*d*) shows the coefficient of correlation between the first antenna element 150 and the second antenna element 151. In the first frequency band of 2.66 GHz and the second frequency band of 4.4 GHz, the coefficient of correlation is a low value less than or equal to 0.2, and is thus an excellent characteristic of the array antenna.

As described above, in Embodiment 1, when the matching circuit of FIG. 3(*a*) is used, it is possible to satisfy both of the loose coupling and matching in the first frequency band and the second frequency band used by operating the first antenna element 150 and the second antenna element 151, and it is possible to obtain high antenna efficiency. Furthermore, it is possible to obtain a low coefficient of correlation, and thus it is possible to design an array antenna with high communication volume.

FIG. 4(*a*) shows configurations of the first impedance matching circuit 112 and the second impedance matching circuit 113 with the constant and circuit configuration different from that of FIG. 3(*a*). FIGS. 4(*b*), 4(*c*), and 4(*d*) shows the same characteristics as FIGS. 3(*b*), 3(*c*), and 3(*d*), and thus the description thereof will be omitted herein.

In FIG. 4(*a*), in the first impedance matching circuit 112 and the second impedance matching circuit 113, in order from the antenna element to the power supply section, 4.0 nH is set for the ground pattern of the circuit board, and 0.6 pF is set for the serial connection. With such a configuration, it is possible to obtain the impedance matching in the broadband in the frequency band ranging from 2.7 GHz to 4.0 GHz.

It can be observed from FIG. 4(*b*) that, in the frequency band ranging from 2.7 GHz to 4.0 GHz, S11 is less than or equal to −10 dB, it is possible to obtain the impedance matching over the broadband. Since the analysis models of FIGS. 2(*a*) and 2(*b*) are bilaterally symmetric, S22 is also a low value less than or equal to −10 dB, but the graph thereof is omitted herein.

Furthermore, in the frequency band from 2.7 GHz to 4.0 GHz, S21 as the pass characteristic is a low value equal to approximately −5 dB. As described above, in the frequency band from 2.7 GHz to 4.0 GHz, it is possible to ensure the impedance matching and isolation over the broadband. As a result, it can be observed that the coupling degradation is reduced.

FIG. 4(*c*) shows the antenna efficiency of the first antenna element 150. In the frequency band from 2.7 GHz to 4.0 GHz, the antenna efficiency is greater than or equal to −3 dB. In the frequency band from 2.7 GHz to 4.0 GHz, S11 is less than or equal to −10 dB, S21 is equal to approximately −5 dB, and the impedance matching and isolation are ensured. Hence, it can be observed that it is possible to obtain high antenna efficiency in the broadband.

Since the analysis models of FIGS. 2(*a*) and 2(*b*) are bilaterally symmetric, in the second antenna element 151, the equivalent antenna efficiency is also ensured, but the graph thereof is omitted herein.

It can be observed from FIG. 4(*d*) that, in the frequency band ranging from 2.7 GHz to 4.0 GHz, the coefficient of correlation is a low value less than or equal to 0.3, and is thus an excellent characteristic of the array antenna.

As described above, in Embodiment 1, when the matching circuit of FIG. 4(*a*) is used, it is possible to satisfy both of the loose coupling and matching in the frequency band as the broadband used by operating the first antenna element 150 and the second antenna element 151, and it is possible to obtain high antenna efficiency. Furthermore, it is possible to obtain a low coefficient of correlation, and thus it is possible to design an array antenna with high communication volume.

Embodiment 2

Figure 5:
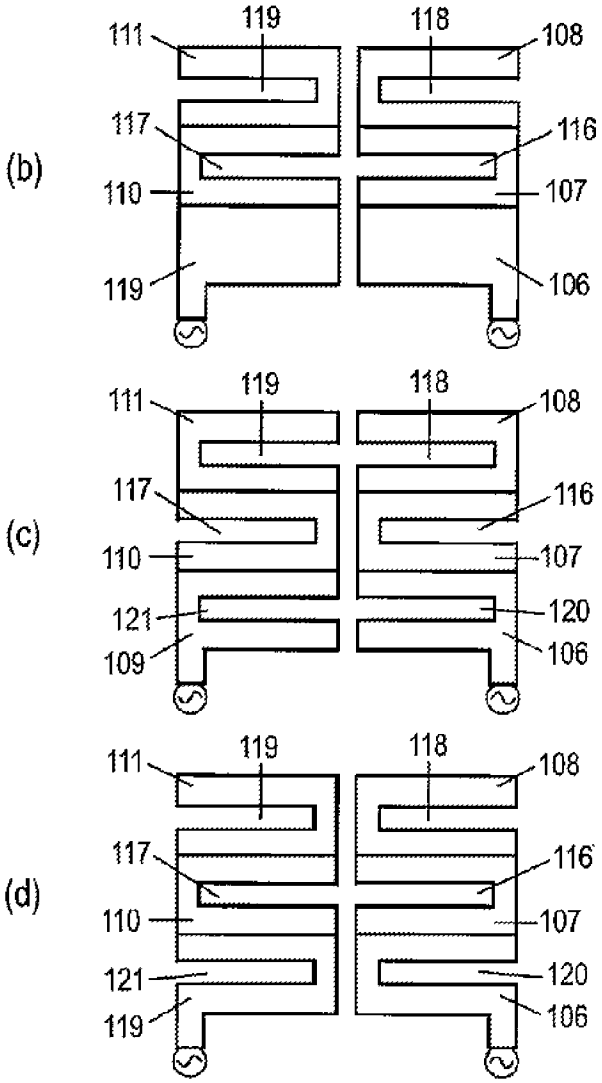
FIGS. 5(*a*) to 5(*d*) are configuration diagrams of the portable wireless terminal according to Embodiment 2 of the present invention.
Figure 5:
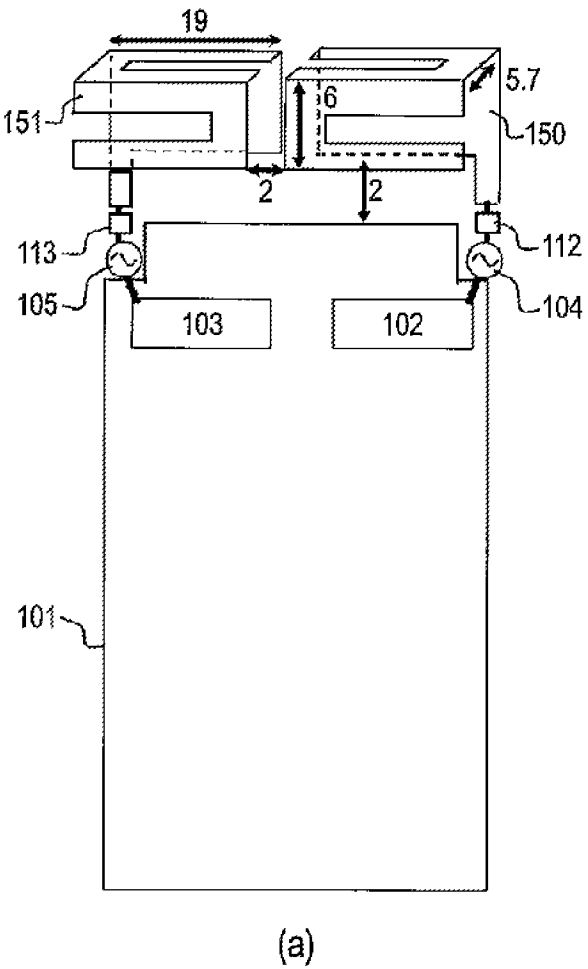
Figure 6:
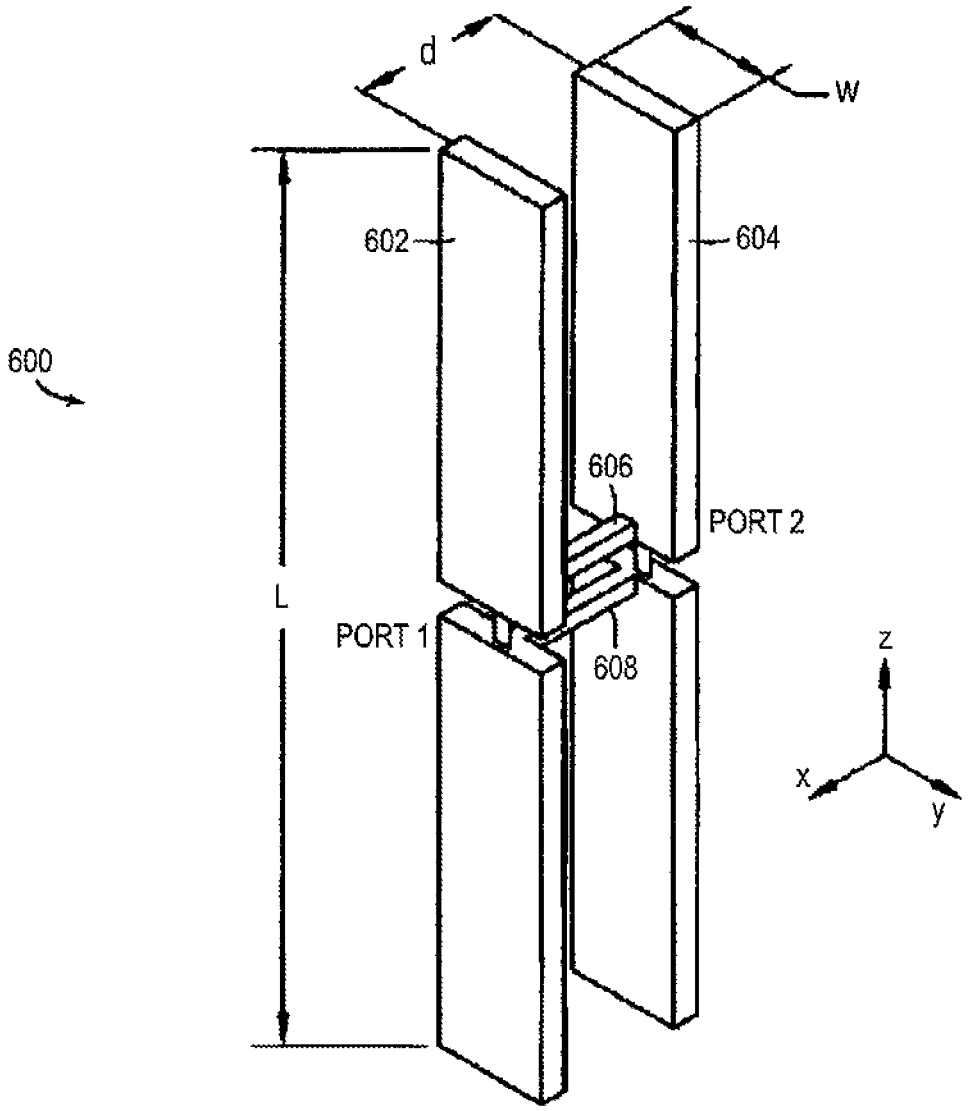
FIG. 6 is a configuration diagram of the existing loosely coupled array antenna.

FIGS. 5(*a*) to 5(*d*) are configuration diagrams of a portable wireless terminal according to Embodiment 2 of the present invention. FIG. 5(*a*) is a diagram showing a view from the front.

In FIGS. 5(*a*) to 5(*d*), the components common to FIGS. 1(*a*) to 1(*c*) will be referenced by the same reference numerals and signs, and description thereof will be omitted.

FIGS. 5(*b*), 5(*c*), and 5(*d*) show variations in the arrangement positions of the slots, which are disposed in the first antenna element 150 and the second antenna element 151, for making the coupling loose.

As shown in FIG. 5(*a*), the circuit board 101 is formed as a printed-circuit board made of glass epoxy. However, the circuit board is formed of a copper foil with a length of 85 mm and a width of 42 mm.

In the circuit board 101, the first antenna element 150 and the second antenna element 151 formed of conductive copper plates are supplied with the high-frequency signal through the first power supply section 104 and the second power supply section 105.

FIG. 5(*b*) is a development view of the first antenna element 150, and shows a configuration in which the slots of the first antenna element 150 and the second antenna element 151 are line-symmetric.

In the configuration of FIG. 5(*b*), the first slit 116 is provided on the second conductor plate 107, and the second slit 117 is provided on the fifth conductor plate 110. Those are slits of which the sides close to the first antenna element 150 and the second antenna element 151 are formed as openings. Further, the third slit 118 is provided on the third conductor plate 108, and the fourth slit 119 is provided on the sixth conductor plate 111. Those are slits of which the sides opposed to the sides close to the first antenna element 150 and the second antenna element 151 are formed as openings.

In the configuration of FIG. 5(*c*), the first slit 116 is provided on the second conductor plate 107, and the second slit 117 is provided on the fifth conductor plate 110. Those are slits of which the sides opposed to the sides close to the first antenna element 150 and the second antenna element 151 are formed as openings. Further, the third slit 118 is provided on the third conductor plate 108, and the fourth slit 119 is provided on the sixth conductor plate 111. Those are slits of which the sides close to the first antenna element 150 and the second antenna element 151 are formed as openings. Furthermore, the fifth slit 120 is provided on the first conductor plate 106, and the sixth slit 121 is provided on the fourth conductor plate 109. Those are slits of which the sides close to the first antenna element 150 and the second antenna element 151 are formed as openings.

In the configuration of FIG. 5(*d*), the first slit 116 is provided on the second conductor plate 107, and the second slit 117 is provided on the fifth conductor plate 110. Those are slits of which the sides close to the first antenna element 150 and the second antenna element 151 are formed as openings. Further, the third slit 118 is provided on the third conductor plate 108, and the fourth slit 119 is provided on the sixth conductor plate 111. Those are slits of which the sides close to the first antenna element 150 and the second antenna element 151 are formed as openings. Furthermore, the fifth slit 120 is provided on the first conductor plate 106, and the sixth slit 121 is provided on the fourth conductor plate 109. Those are slits of which the sides opposed to the sides close to the first antenna element 150 and the second antenna element 151 are formed as openings.

With the configurations of the antenna elements shown in FIGS. 5(*b*), 5(*c*), and 5(*d*), the positions and the number of the adjacent portions between the first antenna element 150 and the second antenna element 151 are changed as viewed from the power supply sections, and it is possible to form a capacity between elements at arbitrary places on the adjacent portions between elements. Hence, by adjusting the capacity between the elements so as to cancel the mutual coupling in the predetermined frequency band, it is possible to improve degradation in the coupling between the antenna elements. Two or more slits may be formed on each conductor plate.

With the above-mentioned configuration, it is possible to further minutely adjust the frequency to achieve low correlation between antennas and high antenna efficiency by loosely coupling the antenna elements without connecting the antenna elements through components and the like. As a result, the effect that reduces coupling degradation further increases.

Although the present invention has been described in detail with reference to specific embodiments, it will be readily apparent to those skilled in the art that various modifications and variations can be made to the embodiments without departing from the spirit and the scope of the present invention.

This application is based on Japanese Patent Application No. 2010-112852 filed on the 17th day of May in 2010, which is incorporated herein by reference.

INDUSTRIAL APPLICABILITY

The antenna device and the portable wireless terminal equipped with the same according to the present invention are able to achieve an array antenna capable of obtaining characteristics of loose coupling in a wide frequency band, and are thus useful for the portable wireless terminals such as a MIMO mobile phone.

REFERENCE SIGNS LIST

100 PORTABLE WIRELESS TERMINAL
101 CIRCUIT BOARD
102 FIRST WIRELESS CIRCUIT SECTION
103 SECOND WIRELESS CIRCUIT SECTION
104 FIRST POWER SUPPLY SECTION
105 SECOND POWER SUPPLY SECTION
106 FIRST CONDUCTOR PLATE
107 SECOND CONDUCTOR PLATE
108 THIRD CONDUCTOR PLATE
109 FOURTH CONDUCTOR PLATE

110 FIFTH CONDUCTOR PLATE
111 SIXTH CONDUCTOR PLATE
112 FIRST IMPEDANCE MATCHING CIRCUIT
113 SECOND IMPEDANCE MATCHING CIRCUIT
116 FIRST SLIT
117 SECOND SLIT
118 THIRD SLIT
119 FOURTH SLIT
120 FIFTH SLIT
121 SIXTH SLIT
150 FIRST ANTENNA ELEMENT
151 SECOND ANTENNA ELEMENT

The invention claimed is:

1. An antenna device comprising:

a casing;

a circuit board that is provided in the casing and has a ground pattern;

a first antenna element that includes a first conductor plate which is disposed in and near the casing and is conductive and substantially rectangular, a second conductor plate which shares one side of the first conductor plate in a widthwise direction thereof, is disposed on the first conductor plate at approximately 90 degrees, and is substantially rectangular, and a third conductor plate which shares the other side in the widthwise direction opposed to the one side of the second conductor plate shared with the first conductor plate, is disposed on the second conductor plate at approximately 90 degrees so as to be opposed to the first conductor plate, and is substantially rectangular, the first conductor plate being substantially parallel to the third conductor plate; and a second antenna element that includes a fourth conductor plate which is disposed in and near the casing and is conductive and substantially rectangular, a fifth conductor plate which shares one side of the fourth conductor plate in a widthwise direction thereof, is disposed on the fourth conductor plate at approximately 90 degrees, and is substantially rectangular, and a sixth conductor plate which shares the other side in the widthwise direction opposed to the one side of the fifth conductor plate shared with the fourth conductor plate, is disposed on the fifth conductor plate at approximately 90 degrees so as to be opposed to the fourth conductor plate, and is substantially rectangular, the fourth conductor plate being substantially parallel to the sixth conductor plate, wherein at least one slit with a predetermined length is provided in at least one of the first conductor plate, the second conductor plate, or the third conductor plate of the first antenna element, wherein the at least one slit with the predetermined length is provided in at least one of the fourth conductor plate, the fifth conductor plate, or the sixth conductor plate of the second antenna element, wherein the first antenna element and the second antenna element are disposed to be close to each other substantially in parallel with each other at a predetermined distance away from the ground pattern on the circuit board, and are electrically connected to a first power supply section and a second power supply section, which are disposed on the circuit board, at both ends of one side of the circuit board, and wherein a position and a length of the slit are adjusted such that mutual coupling between the first antenna element and the second antenna element in a first frequency band is canceled.

2. The antenna device according to claim 1, wherein the first antenna element is electrically connected to the first power supply section through a first impedance matching circuit, and the second antenna element is electrically connected to the second power supply section through a second impedance matching circuit.

3. The antenna device according to claim 1, wherein the antenna device is a MIMO antenna device.

4. A portable wireless terminal comprising the antenna device according to claim 1.

5. The antenna device according to claim 1, wherein the circuit board includes two opposing end edges and two opposing side edges, one side edge extending between an end of one of the end edges and an end of the other end edge and the other side edge extending between another end of the one end edge and another end of the other end edge.

* * * * *